United States Patent [19]

Taylor

[11] 4,147,929

[45] Apr. 3, 1979

[54] OPTICAL PHOTOEMISSIVE DETECTOR AND PHOTOMULTIPLIER

[75] Inventor: Henry F. Taylor, San Diego, Calif.

[73] Assignee: The United States of America as represented by the Secretary of the Navy, Washington, D.C.

[21] Appl. No.: 829,542

[22] Filed: Aug. 31, 1977

[51] Int. Cl.[2] ..... H01J 39/06; H01J 39/12; H01J 39/16

[52] U.S. Cl. ..... 250/207; 250/227; 313/94; 313/95

[58] Field of Search ..... 250/207, 227; 313/94–105 CM; 357/30; 307/311

[56] References Cited

U.S. PATENT DOCUMENTS

| | | | |
|---|---|---|---|
| 2,867,729 | 1/1959 | Morton et al. | 313/105 X |
| 3,310,701 | 3/1967 | Heimann | 313/94 |
| 3,435,233 | 3/1969 | Farnsworth | 250/207 |
| 3,475,076 | 10/1969 | Nelson | 313/94 X |
| 3,873,829 | 3/1975 | Evrard et al. | 313/94 X |
| 3,896,305 | 7/1975 | Ostrowsky et al. | 250/227 |

*Primary Examiner*—Siegfried H. Grimm
*Attorney, Agent, or Firm*—R. S. Sciascia; G. J. Rubens; J. W. McLaren

[57] ABSTRACT

A device for detecting optical energy signals in an optical path is provided by combining a layer of photoemissive material overlying the optical path and a grounded first electrode positioned in electrical contact with the layer of photoemissive material; a second electrode is positioned in spaced, preferably parallel relationship from the first grounded electrode and a source of dc potential is connected across the electrodes. Upon the transmission of optical energy signals along the optical path, commensurate electrical signals are produced across a load resistance which is connected between the second electrode and the high potential side of the dc potential source. Alternatively the concept may be embodied in a photomultiplier responsive to signals in an optical path. In this embodiment a plurality of dynodes are positioned between the first and second electrodes, spaced at gradually increased distances from the layer of photoemissive material. Optical energy signals transmitted along the optical path are thereby detected and multiplied by the electron emission produced at each successive dynode to produce commensurate multiplied signals at a load resistance connected between the second electrode and the source of dc potential. Both of these devices are preferably contained within an evacuated enclosure to enhance electron emission.

6 Claims, 4 Drawing Figures

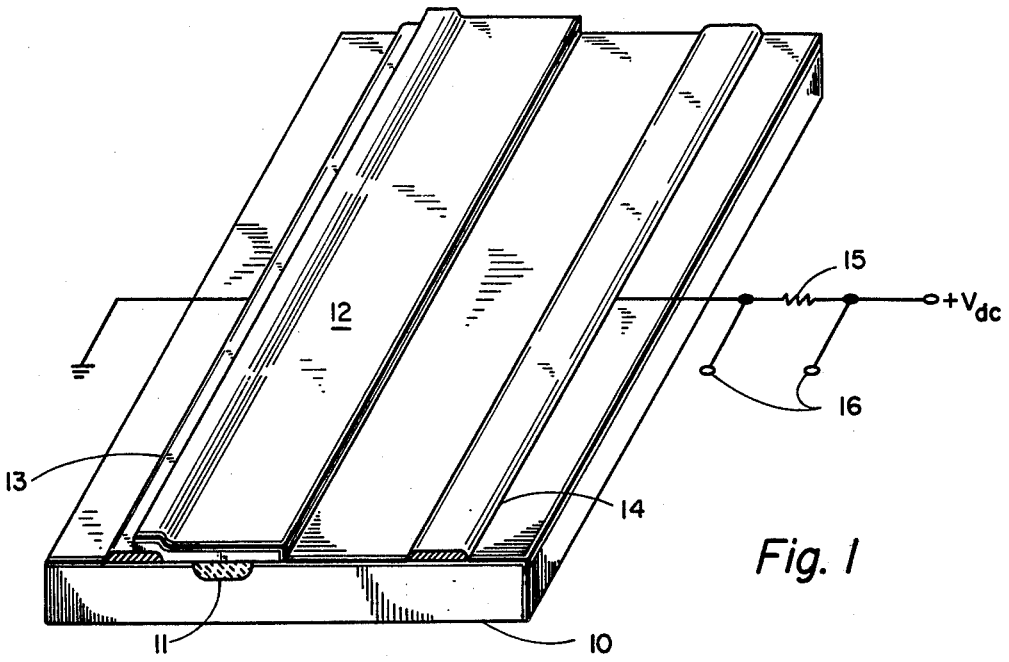
Fig. 1
Fig. 2
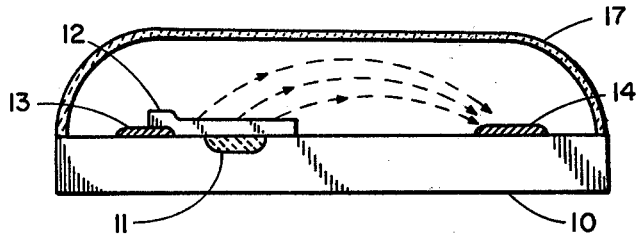
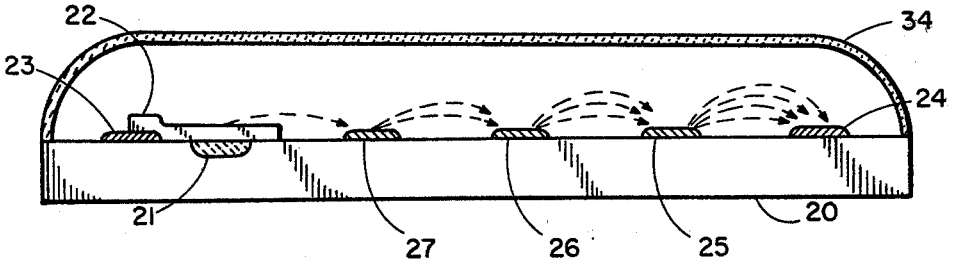
Fig. 4

OPTICAL PHOTOEMISSIVE DETECTOR AND PHOTOMULTIPLIER

BACKGROUND OF THE INVENTION

Prior art optical detectors, which include the vacuum tube type in the form of photodiodes and photomultipliers, have been widely used for a considerable length of time. In these devices the optical light signals to be detected ordinarily pass through a transparent window in the vacuum tube and are absorbed by a photoemissive cathode which provides a target for the optical energy to be detected. Electrons liberated by emission from the surface of the photoemissive cathode are accelerated by a voltage applied across the cathode and anode within the tube. In a vacuum photodiode, for example, the emitted electrons are collected by the anode directly. In a photomultiplier vacuum tube, however, the initial current emitted from the cathode is amplified by means of secondary emission of electrons by a chain of plural intermediate electrodes usually known as dynodes. In this arrangement the anode is the last electrode in the plurality of electrodes and collects the multiplied electron emission provided by the plurality of dynodes between the cathode and the anode. Sensitivity and gain of these types of devices are determined largely by the particular materials employed and also the method of preparing the cathode and the dynodes. Such vacuum tube optical detectors perform quite satisfactorily where relatively large amounts of optical energy are provided in the signals to be detected and where the light energy beams have a relatively large cross section.

Such vacuum tube optical detectors as are known in the present state of the art, however, are not well suited for fiber optic and other waveguide applications for a number of reasons. Firstly, in many fiber optic and waveguide applications a relatively small amount of optical energy is employed in the signals to be detected. Moreover, state of the art vacuum tube optical detectors are relatively large, being usually of the order of several hundred cubic centimeters in volume; in addition state of the art vacuum tube optical detectors are relatively expensive, being in a price range of approximately several hundred dollars per unit. Furthermore, they provide only a relatively low quantum efficiency in certain spectral regions; for example, providing less than 1% quantum efficiency at the 1.06 nanometer spectral range. Added to these disadvantages is the fact that such vacuum tube optical detectors typically provide a undesirably slow response of the order of approximately 2 nanoseconds rise time.

Accordingly, it is desirable that such disadvantages be eliminated wholly or in part by optical energy detection and multiplication in a photoemissive device which can be integrated with an optical waveguide in a single unit.

SUMMARY OF THE INVENTION

The basic concept of the present invention conceives two primary embodiments (1) a photoemissive detector, and (2) a photomultiplier. The photodiode or photoemissive detector configuration employs an optical waveguide having deposited thereon a film of photoemissive material and a grounded first electrode or (photocathode) in contact with the photoemissive material. The optical waveguide may take the form of an optical path having a desired index of refraction differing from that of a dielectric substrate or may also take the form of a fiber optic waveguide. In either case the film or layer of photoemissive material will overlie the optical path.

Accordingly, light energy signals propagating in the optical path will be absorbed by the photoemissive material since it is in direct overlying relationship, causing electrons to be emitted from the surface of the photoemissive film.

A conductive anode is also provided (preferably by deposition or other suitable means) on the surface of the same substrate and spaced from the grounded first electrode. Electrons emitted from the photoemissive film are attracted to the anode (or second electrode) by the application of a dc electric field applied across the two electrodes.

An electrical output signal is thus produced across a load resistance connected between the second electrode and the high potential of the dc potential source. Such electrical output signals are an instantaneous function of the optical energy signals transmitted along the optical path.

The same concept is extended to a photomultiplier by the addition of a plurality of dynodes interposed between the anode and photocathode of the photodetector. The high potential side of a suitable source of dc potential is connected to the anode and suitable means, such as voltage dropping resistors connected to the plurality of dynodes and the source of dc potential, provide gradually diminishing dc potentials for each of the dynodes in accordance with their spatial disposition relative to the cathode, which is comprised of the optical path in the form of a fiber optic or optical waveguide, and overlying film of photoemissive material in contact with a conductive electrode. Preferably, the chain of interconnected resistors may be produced on the same substrate as the other elements of the device for providing an integral unit.

In its operation, optical energy signals propagated along the optical path cause electron emission from the photoemissive material at the cathode, each electron emission striking the dynode nearest causing secondary emission of an increased number of electrons, multiplied in proportion to the number of dynodes employed until collection of the multiplied electron emission is completed at the anode. The resultant multiplied electrical signals produced at a load resistor connected between the anode and the dc source are commensurate with the instantaneous optical light energy signals transmitted along the optical path.

In its preferred embodiments, either form of device embodying the present invention is fabricated on a common supporting substrate to provide a utilized structure. Such substrate may be of any one of a variety of suitable materials including glass, semiconducting III–V or II–VI crystals, such as gallium arsenide or cadmium sulphide, for example. Alternatively, ferroelectric crystals such as lithium niobate may be employed for the substrate.

An optical waveguide in the form of a suitable fiber optic filament or cable may be embedded and bonded to the substrate; alternatively, an optical waveguide may be produced in the substrate by solid state diffusion, ion implantation, ion beam etching, or chemical etching, as desired.

The photoemissive films employed in the present invention may comprise suitable amorphous materials such as cesiated silver oxide, cesium antinomide; or crystalline gallium arsenide, or silicon.

For the photomultiplier embodiment of the present invention suitable secondary emission materials include magnesium oxide, silicon coated with cesium oxide, or gallium phosphide coated with cesium.

Suitable electrically conductive electrodes may be provided by the deposition of an appropriate metal such as aluminum, silver, indium, or gold.

As with most electron emission devices operation is enhanced by encapsulation and containment within an evacuated enclosure.

Accordingly, the concept of the present invention provides a device that is much smaller than the prior art conventional counterparts and additionally provides improved operative speed because of lower interelectrode capacitance and the smaller electrode separation which yields shorter transit times for electron flow.

It is a primary object of the present invention to provide improved photoemissive devices which are particularly adapted for use with present day fiber optic and optical waveguide paths for transmitting light energy signals.

Another most important object of the present invention is to provide such photoemissive devices which will operate at improved quantum efficiencies as contrasted to comparable prior art devices.

A further important object of the present invention is to provide such photoemissive devices which will operate with improved speed of response.

Another most practical object of the present invention is to provide improved photoemissive devices which can be fabricated at significantly less expense than comparably operative prior art devices.

Another object of the present invention is to provide a concept for photoemissive devices which may be embodied into either a photodetector or a photomultiplier configuration.

Yet a further object of the present invention is to provide photoemissive devices which may be fabricated as a unitized structure supported on a common substrate.

Another concomitant object of the present invention is to provide a concept for fabricating photoemissive devices which is particularly adapted to the special size requirements of optical waveguides.

These and other features, objects, and advantages of the present invention will be better appreciated from an understanding of the operative principles of a preferred embodiment as described hereinafter and as illustrated in the accompanying drawings.

BRIEF DESCRIPTION OF THE DRAWINGS

In the drawings:

FIG. 1 is a perspective view of one embodiment of the present invention;

FIG. 2 is an end view of the embodiment illustrated in FIG. 1;

FIG. 4 is an end view of the embodiment of the present invention illustrated in FIG. 3.

DESCRIPTION OF THE PREFERRED EMBODIMENTS

Figure 3:
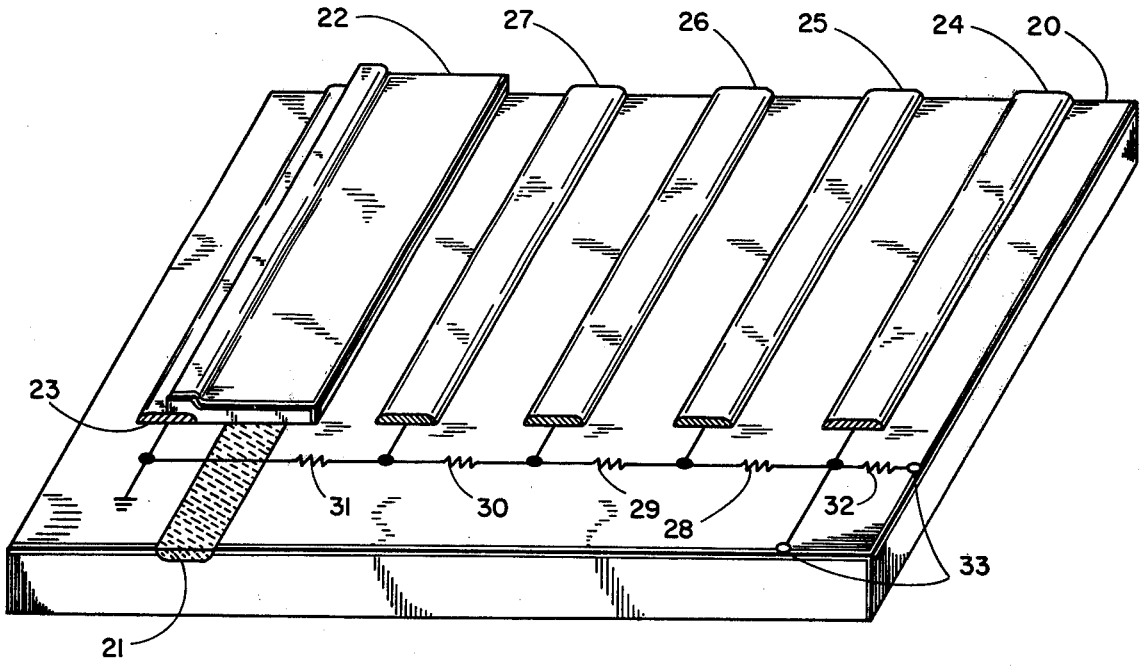
FIG. 3 is an illustration of a variant embodiment of the present invention.

The concept of the present invention may be embodied in the form of a photodiode or photoemissive detector, and also as a photomultiplier, each being responsive to receive optical energy signals. FIG. 1 is a perspective view of an embodiment of the present invention which is operative as a photoemissive detector or photodiode. A substrate 10 comprising a suitable dielectric material, for example, supports an optical path 11 for transmitting optical energy signals. In the particular embodiment illustrated in FIG. 1 the optical path 11 may comprise an optical waveguide fabricated into the substrate 10 by solid state diffusion, ion implantation, ion beam etching, or chemical etching, the choice of the method of fabricating the optical path being dependent upon the particular application of the present invention, the wavelength, and other parameters of the optical energy signals to be transmitted and propagated along the optical path 11. Alternatively, the optical path 11 may comprise fiber optic filaments or cable embedded and bonded to and supported by the dielectric substrate 10.

A layer of photoemissive material 12 overlies the optical path 11 so as to be in intimate optical relationship thereto receiving optical energy signals propagated along the optical path 11. A grounded first electrode 13 is positioned in contact with the layer of photoemissive material 12 and, as shown in FIG. 1, such contact is accomplished by the fact that the layer of photoemissive material 12 slightly overlaps the electrode 13, as well as overlying the optical path 11.

A second electrode 14 is positioned in spaced relationship from the grounded first electrode 13 and is also supported by the common dielectric substrate 10. A suitable source of dc potential indicated as $+V_{dc}$ in FIG. 1 is connected to the electrode 14 through a load resistor 15.

In operation, optical energy signals transmitted and propagated along the optical path 11 will cause commensurate electron emission in accordance with the amplitude and intensity of such optical energy signals, thereby producing an electron flow from the photoemissive material 12 to the high potential electrode 14. Accordingly, the grounded electrode 13 and the photoemissive material 12 in contact therewith function in the manner of a cathode, while the high potential electrode 14 functions in the manner of an anode receiving the emitted electrons from the photoemissive material 12.

Accordingly, a commensurate change is produced across the load resistor 15 which is indicative of the amplitude and duration of the optical energy signals transmitted along the optical path 11. Electrical signals are thus produced across the output terminals 16 which are representative of the instantaneous amplitude and duration of optical energy signals propagated along the optical path 11, and the embodiment illustrated in FIG. 1 functions in the manner of a photoemissive detector or photodiode.

One of the principle advantages of the present invention, as contrasted to known prior art photoemissive detectors and photodiodes, is the fact that it is preferably fabricated as a unitized device and supported on a common substrate in a minimal space. This renders the device very rugged and reliable, as well as being small in size. Additionally, it is preferred that the embodiment of the present invention, as illustrated in FIG. 2 be encapsulated under vacuum to enhance the electron flow and thus render the device more efficient.

FIG. 2 is an end view of the embodiment illustrated in FIG. 1 wherein like elements bear the same numerical designation. FIG. 2 more clearly illustrates the manner in which the photoemissive material produces emitted electrons in response to optical energy signals propagated along the optical path 11. The dotted lines with arrows depict a path from the photoemissive material 12 to the high potential electrode 14 illustrating the electron trajectory which causes the change of potential across the load resistor 15 and the resultant electrical output signals across the output terminals 16. The entire unitized assembly is contained within an evacuated enclosure 17.

FIG. 3 illustrates a variant embodiment of the present invention which performs in the manner of a photomultiplier. A dielectric substrate 20 supports an optical path 21 which is illustrated in the form of an optical waveguide, but may also take the alternate form of a fiber optic filament or cable as previously described in connection with the explanation of the operation of the embodiment illustrated in FIGS. 1 and 2. A layer of photoemissive material 22 overlies the optical path 21 and is similarly supported on the common substrate 20. A grounded first electrode 23 is positioned in electrical contact with the layer of photoemissive material 22 by reason of the latter partially overlying electrode 23. Electrode 23 is connected to ground potential in much the same manner as the comparable electrode shown in the embodiments of FIGS. 1 and 2.

A second electrode 24 is supported on the common substrate 20 in a spaced relationship from the first grounded electrode 23. A plurality of dynodes 25, 26, and 27 comprised of photoemissive material are positioned between the first electrode 23 and the second electrode 24 and spaced at gradually increased distances from the layer of photoemissive material 22.

A suitable source of dc potential $+V_{dc}$ is impressed upon a plurality of series-connected resistors 28, 29, 30 31 and 32. Resistor 28 has its high potential side connected to the electrode 24, resistor 29 has its high potential side connected to the dynode 25, resistor 30 has its high potential side connected to dynode 26, and resistor 31 has its high potential side connected to dynode 27.

In the embodiment illustrated in FIG. 3 the grounded first electrode 23 functions in the manner of a cathode while the electrode 24 functions in the manner of an anode. In operation, when optical energy signals are transmitted or propagated along the optical path 21, the photoemissive character of the layer material 22 is caused to emit electrons commensurate with the intensity of the optical energy which it receives by reason of its overlying position relative to the optical path 21. Such emitted electrons are received by the dynode 27 which then produces a secondary electron emission in multiplication of the electrons received by it. In a similar manner dynode 26 receives the secondary electron emission and produces a multiplied electron emission of its own which, in turn, is received by dynode 25 where a further electron multiplication is caused to occur.

The electron emission as thus multiplied by the successive electron trajectories between the electron emissive materials 22, 27, 26, and 25 are collected at the electrode 24 by reason of the successively higher graduated potentials produced between the electron emissive materials 22, 27, 26, and 25. Accordingly, changes of potential commensurate with received optical energy signals are developed across the load resistor 32 connected between the anode 24 and the source of dc potential, and are detected at the output terminals 33.

FIG. 4 is an end view of the embodiment of FIG. 3 which more fully illustrates the manner in which photomultiplication takes place. Comparable elements in FIG. 4 bear the same numerical designation as in FIG. 3. In FIG. 4 the dotted lines and arrows are symbolically representative of the electron trajectories followed by electron emission from the successive electron emissive materials 22, 27, 26 and 25. It will be noted that a single electron trajectory is represented as emanating from the layer of photoemissive material 22 overlying the electrode 23 or photocathode. The electrons thus caused to be emitted from the photoemissive material 22 are received at the dynode 27 comprised of secondary emissive material and are shown as being multiplied to produce additional electron emission from the dynode 27. Similarly, the electron trajectories of the electron flow emitted from the dynode 27 causes additional secondary emission of electrons from the dynode 26 with increased multiplication of the electron flow resulting in further multiplied secondary emission from the dynode 25. The final multiplication, representative of the propagation of optical energy signals in the optical path 21, is collected at the electrode 24 which functions in the manner of an anode. Preferably, the entire unitized structure is encapsulated in vacuum and contained within an enclosure 34 to enhance electron flow.

Those skilled and knowledgeable in the pertinent prior arts will be aware that one of the prime advantages of the present invention in addition to its small size is that it may be fabricated as a unitized structure on a common substrate.

The optical path 21 may take the form of an optical waveguide produced by solid state diffusion, ion implantation, ion beam etching, or chemical etching in the substrate 20.

The photoemissive films deposited to form the layer of photoemissive material 22 may be suitable amorphous or crystalline materials as indicated hereinbefore.

The dynodes 25, 26, and 27, performing secondary emission functions, may be formed by deposition of magnesium oxide, silicon coated with cesium oxide, or gallium phosphide coated with cesium, for example.

The conductive electrodes 23 and 24 may be formed by the deposition of aluminum, silver, indium, or gold.

In a similar manner the resistances 28, 29, 30, 31, and 32 as well as the terminals 33, may be fabricated by suitable deposition on the common substrate 20.

It should be fully appreciated by those skilled and knowledgeable in the prior art that the illustrations of two typical embodiments of the present invention, one performing a photodiode function and the other a photomultiplier function, are both very greatly enlarged for purposes of illustration and understanding and are not shown to scale.

It is obvious that the extremely small dimensions of elements of the present invention render it an extremely small, compact, and ruggedized device. The fact that the present invention may be embodied in devices which are significantly smaller than conventional devices performing comparable operative functions, leads to improved speed of operation because of significantly lower interelectrode capacitance and smaller electrode separation producing shorter transit times for the electron flow.

Additionally, quantum efficiency is greatly increased due to the very thin film of photoemissive material which could be used in contact with the optical path such as a waveguide, for example, leading to a high probability of emission for electrons excited in the photocathode material.

Moreover, the concept of the present invention is such that devices embodying it respond much faster than semiconductor detectors due to the fact that electron propagation under vacuum conditions is much faster than through the solid state medium. Furthermore, sensitivity can be much improved in the photoemissive device of the present invention and dark current greatly reduced in comparison with functionally comparable semiconductor detectors.

Obviously many modifications and variations of the present invention are possible in the light of the above teachings. It is therefore to be understood that within the scope of the appended claims the invention may be practiced otherwise than as specifically described.

What is claimed is:

1. An optical photoemissive detector comprising:
an optical waveguide for transmitting optical energy signals;
a layer of photoemissive material overlying said optical waveguide;
a grounded first electrode position in contact with said layer of photoemissive material;
a second electrode positioned in spaced relationship from said grounded first electrode;
a common substrate which supports said optical waveguide, said layer of photoemissive material, and said electrodes;
a source of dc potential connected across said electrodes; and
a load resistance connected between said second electrode and the high potential of said dc potential source, whereby said optical energy signals transmitted along said optical path produce commensurate electrical signals across said load resistance.

2. An optical photoemissive detector as claimed in claim 1 wherein said electrodes and layer of photoemissive material are contained within an evacuated enclosure.

3. An optical photoemissive detector as claimed in claim 1 wherein said electrodes are disposed in parallel relationship.

4. An optical photoemissive detector as claimed in claim 1 wherein said optical waveguide comprises an optical fiber at least partially coated with photoemissive material.

5. An optical photomultiplier comprising:
an optical path for transmitting optical energy signals;
a layer of photoemissive material overlying said optical path;
a grounded first electrode positioned in contact with said layer of photoemissive material;
a source of dc potential;
a second electrode positioned in spaced relationship from said grounded first electrode and connected to the high potential side of said source of dc potential;
a plurality of dynodes comprised of secondary emission material positioned between said first and second electrodes, and spaced at gradually increased distances from said layer of photoemissive material;
a common substrate which supports said optical path, said layer of photoemissive material, said electrodes, and said dynodes;
means for developing graduated potentials from said source of dc potential;
means connecting each of said graduated potentials to one of said dynodes in accordance with its spaced distance from said first grounded electrode; and,
a load resistance connected between said second electrode and said source of dc potential, whereby the electrical signals developed across said load resistance are the instantaneous multiples of the optical energy signals transmitted along said optical path.

6. A photomultiplier as claimed in claim 5 wherein said electrodes, dynodes, and said layer of photoemissive material are contained within an evacuated enclosure.

* * * * *